US008764609B1

(12) United States Patent
Elahmadie

(10) Patent No.: US 8,764,609 B1
(45) Date of Patent: Jul. 1, 2014

(54) EXERCISE ENHANCEMENT MACHINE

(76) Inventor: Issam A. Elahmadie, Myrtle Beach, SC (US)

( * ) Notice: Subject to any disclaimer, the term of this patent is extended or adjusted under 35 U.S.C. 154(b) by 0 days.

(21) Appl. No.: 13/475,992

(22) Filed: May 20, 2012

(51) Int. Cl.
*A63B 21/005* (2006.01)
*A63B 22/06* (2006.01)
*A63B 69/16* (2006.01)
*A63B 71/00* (2006.01)

(52) U.S. Cl.
USPC ..... 482/5; 482/57; 482/1; 482/51

(58) Field of Classification Search
USPC ..... 482/1–9, 57, 72–73, 51, 52, 71, 78
See application file for complete search history.

(56) References Cited

U.S. PATENT DOCUMENTS

| | | | | |
|---|---|---|---|---|
| 5,313,942 | A | 5/1994 | Platzker | |
| 5,439,433 | A | 8/1995 | Lundin et al. | |
| 5,700,228 | A | 12/1997 | James | |
| 5,737,786 | A * | 4/1998 | Yamamoto | 5/618 |
| 5,746,684 | A | 5/1998 | Jordan | |
| 6,064,426 | A * | 5/2000 | Waterman | 348/63 |
| 6,361,479 | B1 * | 3/2002 | Hildebrandt et al. | 482/72 |
| 7,189,193 | B2 * | 3/2007 | Egger | 482/57 |
| D621,889 | S | 8/2010 | Horita et al. | |
| 2002/0019299 | A1 * | 2/2002 | Abelbeck | 482/57 |
| 2002/0119867 | A1 * | 8/2002 | Stearns et al. | 482/52 |
| 2004/0198561 | A1 * | 10/2004 | Corbalis et al. | 482/57 |
| 2005/0032608 | A1 | 2/2005 | Glusco | |
| 2005/0164838 | A1 | 7/2005 | Watterson et al. | |
| 2007/0049470 | A1 * | 3/2007 | Pyles et al. | 482/95 |
| 2008/0058164 | A1 * | 3/2008 | Douglas et al. | 482/5 |
| 2008/0093522 | A1 * | 4/2008 | Oddsen et al. | 248/276.1 |
| 2008/0113853 | A1 * | 5/2008 | Jang | 482/142 |
| 2008/0248926 | A1 * | 10/2008 | Cole et al. | 482/5 |
| 2009/0036274 | A1 * | 2/2009 | Greene et al. | 482/57 |
| 2009/0048073 | A1 * | 2/2009 | Roimicher et al. | 482/52 |
| 2010/0022354 | A1 | 1/2010 | Fisher | |
| 2010/0113223 | A1 * | 5/2010 | Chiles et al. | 482/5 |

* cited by examiner

*Primary Examiner* — Patricia Bianco
*Assistant Examiner* — Shila Jalalzadeh Abyan
(74) *Attorney, Agent, or Firm* — P. Jeff Martin; The Law Firm of P. Jeffrey Martin, LLC

(57) ABSTRACT

An exercise machine includes a frame, an adjustable seat assembly, a means for slidably adjusting the seat assembly axially along the frame, a means for pivotally adjusting the seat assembly between a generally upright position and a recumbent position, an adjustable resistance assembly which includes rotatable pedals, and a display panel with means for providing omnidirectional positionability of the display panel. The exercise machine allows a user thereof to simultaneously perform crunching exercises and actively engage the adjustable resistance assembly in order to allow the user to reach the highest, optimized levels of cardiovascular fitness and calorie burning during a physical exercise interval.

13 Claims, 7 Drawing Sheets

EXERCISE ENHANCEMENT MACHINE

RELATED APPLICATIONS

There are no previously filed, nor currently any co-pending applications, anywhere in the world.

BACKGROUND OF THE INVENTION

1. Field of the Invention

The present invention relates generally to exercise equipment and accessories therefor, and more particularly, to an exercise machine configured to enhance cardiovascular fitness, physical fitness, and calorie burning during a physical exercise training interval.

2. Description of the Related Art

Currently there exist in the art various equipment for fitness exercise, physical therapy, and stress testing. However, the prior art has failed to disclose or teach an exercise machine having a seat assembly with a back rest being pivotally adjustable to a recumbent position, and a resistance assembly, thereby allowing a user to simultaneously perform crunching exercises and actively engage the resistance assembly in order to maximize the possibility of a user reaching the highest, optimized levels of cardiovascular fitness and calorie burning during a physical exercise interval.

In addition, the prior art has failed to teach or disclose an exercise machine which includes a display panel mounted to exercise machine via a mounting assembly with means for providing omnidirectional positionability of the display panel.

Accordingly, a need exists for an exercise machine which allows for cardiovascular and/or resistance training to be engaged in while concurrently lying in a recumbent position and performing crunching exercises so as to maximize the possibility of a user reaching the highest, optimized levels of cardiovascular fitness and calorie burning during a physical exercise interval. The development of the exercise enhancement machine fulfills this need.

A search of the prior art did not disclose any patents that read directly on the claims of the instant invention; however, the following references were considered related:

U.S. Pat. No. 6,361,479 B1, issued in the name of Hildebrandt et al.;

U.S. Pat. No. 5,746,684, issued in the name of Jordan;

U.S. Patent Application no. 2010/0022354 A1, published in the name of Fisher;

U.S. Patent Application no. 2005/0032608 A1, published in the name of Glusco;

U.S. Pat. No. 5,700,228, issued in the name of James;

U.S. Patent Application no. 2005/0164838 A1, published in the name of Watterson et al.;

U.S. Pat. No. 5,313,942, issued in the name of Platzker;

U.S. Pat. No. D621,889 S, issued in the name of Horita et al.; and

U.S. Pat. No. 5,439,433, issued in the name of Lundin et al.

Consequently, a need has been felt for an exercise machine which allows for cardiovascular and/or resistance training to be engaged in while concurrently lying in a recumbent position and performing crunching exercises so as to maximize the possibility of a user reaching the highest, optimized levels of cardiovascular fitness and calorie burning during a physical exercise interval.

This application presents claims and embodiments that fulfill a need or needs not yet satisfied by the products, inventions and methods previously or presently available. In particular, the claims and embodiments disclosed herein describe an exercise machine comprising a frame for supporting a seat assembly, the seat assembly comprising a seat and a back rest, the back rest being pivotally adjustable between a generally upright position and a recumbent position; means for sliding the seat assembly axially along the frame of the exercise machine; a resistance assembly; an adjustable resistance mechanism; and an input means mounted to exercise machine via a mounting assembly with means for providing omnidirectional positionability of the input means, the exercise machine providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Briefly described according to one embodiment of the present invention, an exercise machine is disclosed, the exercise machine comprises a frame which includes a front support, a rear support, and central support integrally joining front and rear support. The frame further includes a shroud portion extending between the front and central supports, the shroud portion partially encloses a carriage assembly and an adjustable resistance mechanism.

The exercise machine further comprises a seat assembly adjustably mounted to the frame. The seat assembly comprises a seat and a back rest, the back rest is pivotally adjustable to assume a number of positions. The seat is positionable to a recumbent position, thereby allowing user to perform a crunching exercise while simultaneously actively engaging the resistance assembly using user's feet.

A means for sliding the seat assembly axially along the frame of the exercise machine is further provided.

The resistance assembly comprises pedals, such as rotatable pedals, connected to an adjustable resistance mechanism which applies a constant resistance or work load. The adjustable resistance mechanism comprises a drive system enclosed by a housing. The drive system is controlled via an electronic control unit electrically connected thereto. The electronic control unit includes a plurality of control buttons by which user may input his/her desired level of resistance or work load. Alternatively, users may input desired resistance via an input means. The input means, according one embodiment, is a display panel comprising a touch sensitive screen. The display panel is mounted to the exercise machine via a mounting assembly with means for providing omnidirectional positionability of the display panel.

A carriage control unit, electrically connected to the drive system, controls inclined translation of carriage assembly about an incline plane, hence controlling translation of pedals to a selectively-desired inclined height.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
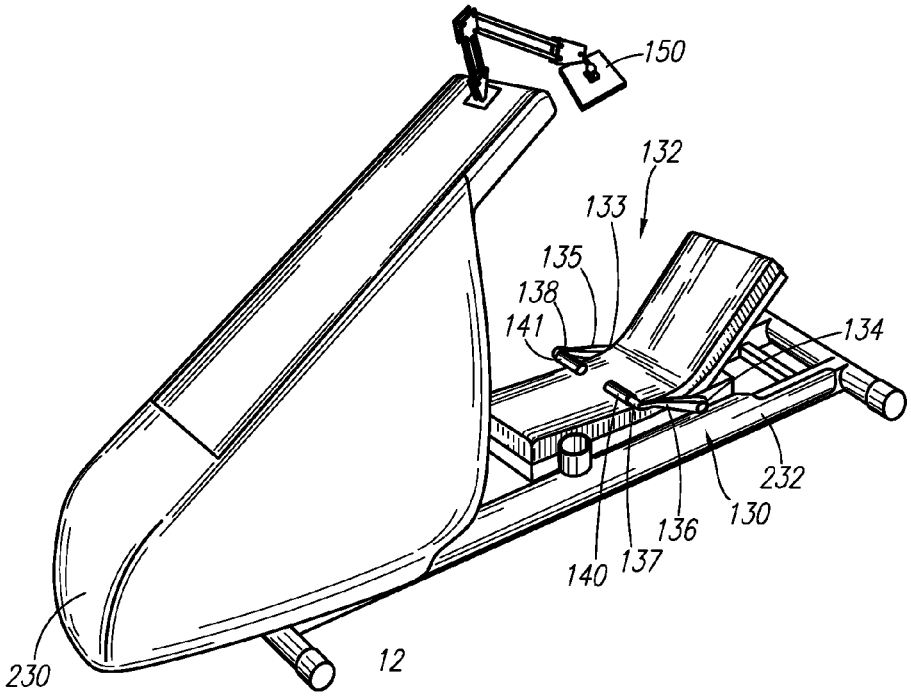
FIG. 1 is a left frontal perspective view of an exercise machine, according to one embodiment of the present invention.
Figure 2:
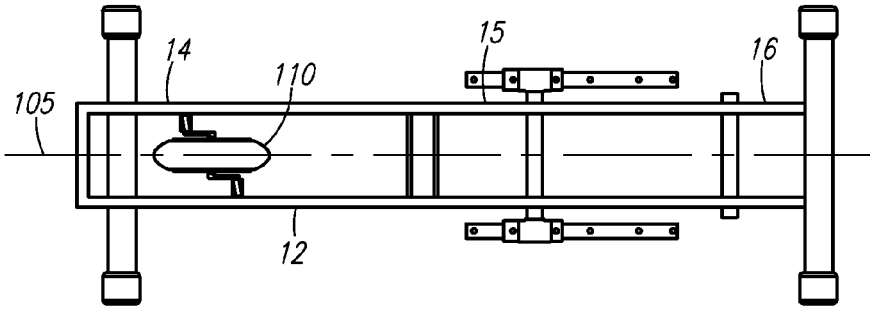
FIG. 2 is a bottom plan view of the frame showing the adjustable resistance mechanism of the exercise machine secured thereto, in accordance to one embodiment of the present invention.

Referring now to FIGS. 1-2, an exercise machine 10 is shown, according to one embodiment of the present invention. The exercise machine 10 comprises a frame 12 which includes a front support 14 and a rear support 16. The front support 14 is spaced from the rear support 16 generally along a central axis 105. Preferably, the frame 12 is constructed of tubular steel, but may also be made from steel in various stock forms such as plate stock and angle stock. The front support 14 and rear support 16 are integrally joined by a central support 15. The front support 14, central support 15, and rear support 16 may collectively define generally an H-shaped configuration.

Referring now more specifically to FIGS. 2-5, a carriage assembly support frame 11 is provided for supporting a carriage assembly 19. Support frame 11 comprises a first and second vertical member 11*a* and 11*b* mounted to the front support 14 of frame 12 about respective lower ends thereof. The first and second vertical members 11*a* and 11*b* each having upper ends welded or molded integral to a cross member 11*c*. A first and a second stanchion 17 and 18 each having lower ends respectively mounted or welded to outer walls of first and second vertical member 11*a* and 11*b*.

The carriage assembly 19 comprises a transverse support rod 26 and tracks 20 and 22. The support rod 26 having ends rotatably mounted with guide rollers 27 by means of bearings disposed therein. The tracks 20 and 22 are respectively mounted to the inside side walls 17*a*, 18*a* of the first and second stanchion 17 and 18. The tracks 20 and 22 are generally C-shaped and each comprises a pair of flanges 21 and 23 joined by a central web 24, 25. The flanges 21 and 23 provide bearing surfaces on which the guide rollers 27 rotatably engage. The tracks 20 and 22 are further defined as having curved lower ends. Upper ends of the tracks 20 and 22 are mounted to a cross member 28. A panel adjustment assembly support 200 or mounting plate is securably mounted, such as by arc welding, transversely to the upper surface of track 20 and sidewall of cross member 28. The panel adjustment assembly support 200 (FIG. 5) shall be described later in greater detail.

The carriage assembly 19 further comprises a pair of support brackets 30 for securably supporting a resistance assembly 60, which includes an adjustable resistance mechanism 110 (to be described later in greater detail). The support brackets 30 are mounted spatially about the transverse support rod 26 and include a lower surface edge to which the front member 119*a* of housing 119 of resistance mechanism 110 is suitably mounted. Inside walls of the brackets 30 are joined by an annular collar 29 suitably mounted, such as by arc welding, therebetween for threaded translation along a guide rod 32. The guide rod 32 is rotatably mounted perpendicularly between cross member 28 and a receiver 33 mounted to the front support 14, wherein guide rod 32 includes male threads being threadedly engaged by annular collar 29. The guide rod 32 is electrically connected to a driving means 106, whereupon actuation of driving means 106 causes guide rod 32 to rotate either clockwise or counterclockwise. Rotation by guide rod 32 in one direction causes annular collar 29 to translate about guide rod 32 in a sloped or inclinational direction, thereby causing adjustable resistance mechanism 110 to translate in one inclinational direction, and rotation by guide rod 32 in the opposite direction causes adjustable resistance mechanism 110 to translate in the opposite inclinational direction.

The frame 12 further includes a shroud portion 230, extending between the front and central supports 14 and 15, which partially encloses the carriage assembly 19 and adjustable resistance mechanism. The shroud portion 230 is further defined has having a generally conical shape having an elongated sloped forward segment covering outer walls of tracks 20, 22 and cross member 28. The shroud portion 230 includes lower opposed ends extending integrally into linearly elongated opposing strips 232 for covering central support 15 and rear support 16 of frame 12. The shroud portion 230 provides the exercise machine 10 with an aerodynamic, cutting edge shape.

Referring now more particularly to FIGS. 5-9, the exercise machine 10 further comprises a seat assembly 40 adjustably mounted to the frame 12. An electric drive assembly 70 (to be described later in greater detail) is actuated for sliding the seat assembly 40 axially along the frame 12 for varied position adjustment.

The seat assembly 40 comprises a seat 42 and a back rest 44, the back rest 44 is pivotally adjustable about a first and second pivot axis 46 and 47 to assume a number of positions, via a back rest pivot control 45, the back rest 44 being adjustable between a generally upright position and a recumbent position (substantially flat or horizontal). The seat 42 may also be configured with a hinge so as to allow seat 42 to be adjustable between an inclined position and a recumbent position, the seat 42 being pivotally adjustable about a third pivot axis 47*a*. The seat 42 and the back rest 44 are preferably defined as being cushioned. When seat 42 and back rest 44 are positioned in the recumbent position, the user may simultaneously perform a crunching exercise and engage a resistance assembly 60 of the adjustable resistance mechanism 110 using user's feet.

The pivot control unit 45 is electrically connected to a pivot drive mechanism 50, shown herein as a motor, but may include other drive mechanisms or assemblies such as hydraulic. Pivot drive mechanism 50 may be suitably secured to a cross beam 51 mounted perpendicularly between rear support 16. Pivot control unit 45 controls the pivot drive mechanism 50 to pivotally raise and lower the back rest 44 about pivot axes 46 and 47 via a conventional mechanism, or assembly as is known in the art for pivotally raising and lowering structures, such as via rotation of a drive cam 49 or reel by motor, the cam 49 mounted to a first and second axle defined respectively as pivot axes 46 and 47. Pivot control unit 45 may also control the pivot drive mechanism 50 to pivotally raise and lower the seat 42 portion of seat assembly about pivot axis 47*a*.

The pivot control unit 45 includes a plurality of pivot control buttons 48 by which user may depress or input a selectively-desired back rest 44 pivotal position. Once the desired back rest 44 position is achieved, user releases button 48 causing back rest 44 to remain stationary in the selected pivotal orientation.

As previously described, the electric drive assembly 70 is actuated for sliding the seat assembly 40 axially along the frame 12 for varied position adjustment. The electric drive assembly 70 comprises a motor 72, such as a DC motor. The electric drive assembly 70 is suitably mounted to a drive assembly support member 97 mounted or welded perpendicularly across rear support members 16*a*, 16*b*.

A pair of stationary rails 52, 53 is mounted respectively to the outer sidewall of rear support members 16*a*, 16*b* via a mounting bracket 16*c*, 16*d*. Each rail 52, 53 having an elongated cover plate 54, 55 secured to an upper surface thereof. A rail support 56 is mounted or welded perpendicularly across rear support 16 and cover plates 54, 55, wherein rail support 56 being oriented distally forward of drive assembly support member 97.

Each elongated cover plate 54, 55 includes a pair of guide rod mounts 57 mounted spatially along the upper surface thereof, each the guide rod mounts 57 pair having a guide rod 92 mounted therebetween and oriented generally parallel to the pair of stationary rails 52, 53, respectively.

A seat platform 58, suitably mounted to the underside of seat 42, comprises a pair of feet 59 molded integral or mounted to opposing lower surface corners thereof. The feet 59 being slidably mounted to respective guide rods 92 for longitudinal translation therealong. More specifically, each foot 59 each includes a guide hole 90 through which a respective guide rod 92 slidably engages.

Seat platform 58 further comprises a pair of caster assemblies 240 mounted to opposing bottom side, forward corners of seat platform 58, the caster assemblies 240 each comprising a caster 242 or wheel for rotatably engaging an upper surface of front support members 14*a*, 14*b*, respectively, of front support 14 of frame 12. The front support members 14*a*, 14*b* providing bearing surfaces on which the casters 242 rotatably engage in a concurrent, cooperative manner with the feet 59, as feet 59 translate longitudinally along respective guide rods 92. Each of the pair of caster assemblies 240 may be any suitable commercially available product that typically includes a rubber wheel or caster 242 that rotates about a horizontal (rolling motion) axis.

A seat control unit 94, electrically connected to the electric drive assembly 70, controls axial translation of seat 42 along guide rods 92. Seat control unit 94 includes a plurality of directional control buttons 96 by which user may signal the electric drive assembly 70 to actuate forward and reverse translation of seat 42 in accordance to user's longitudinal seat 42 position preference.

While one particular variety of seat adjustment assembly has been specifically described in detail, it will be appreciated that numerous other types of adjustment means and mechanisms could be substituted for the adjustment assembly 70 illustrated and describe hereinabove. Alternate adjustment means and mechanisms are therefore deemed to be within the scope of the present invention.

Figure 3:
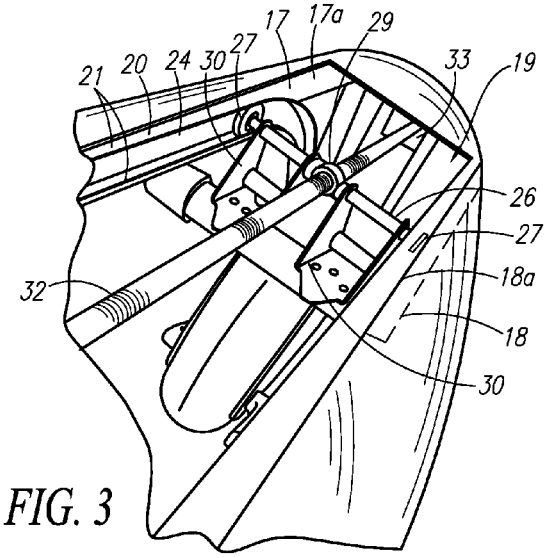
FIG. 3 is a partial top left side view of the exercise machine of FIG. 1 illustrating a carriage assembly, the exercise machine shown with the shroud partially removed.
Figure 2A:
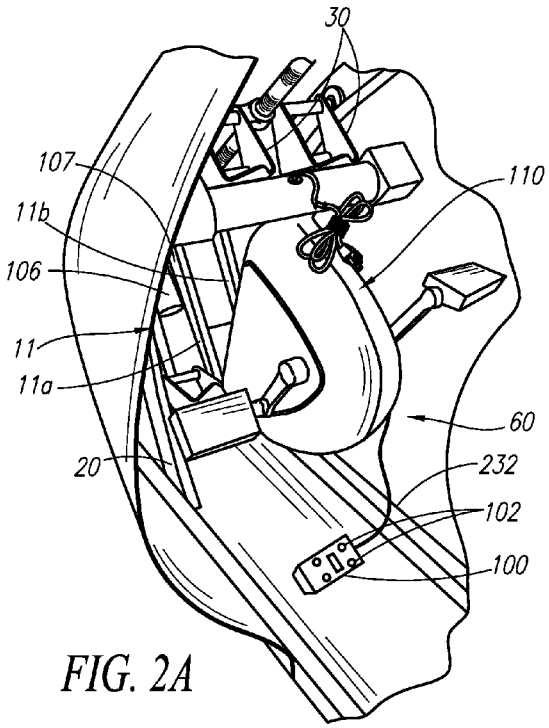
FIG. 2A is a partial left perspective view of the exercise machine illustrating the resistance assembly, the exercise machine shown with the shroud partially removed, in accordance to one embodiment of the present invention.
Figure 4:
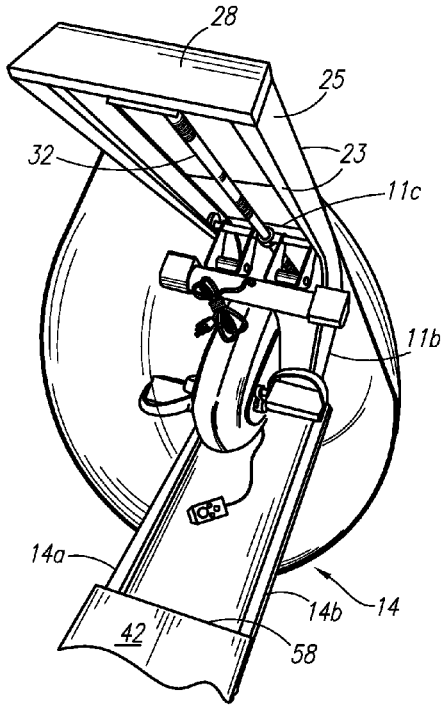
FIG. 4 is a rear perspective view of the exercise machine illustrating components of the carriage assembly, the exercise machine shown with the shroud partially removed, in accordance to one embodiment of the present invention.
Figure 11:
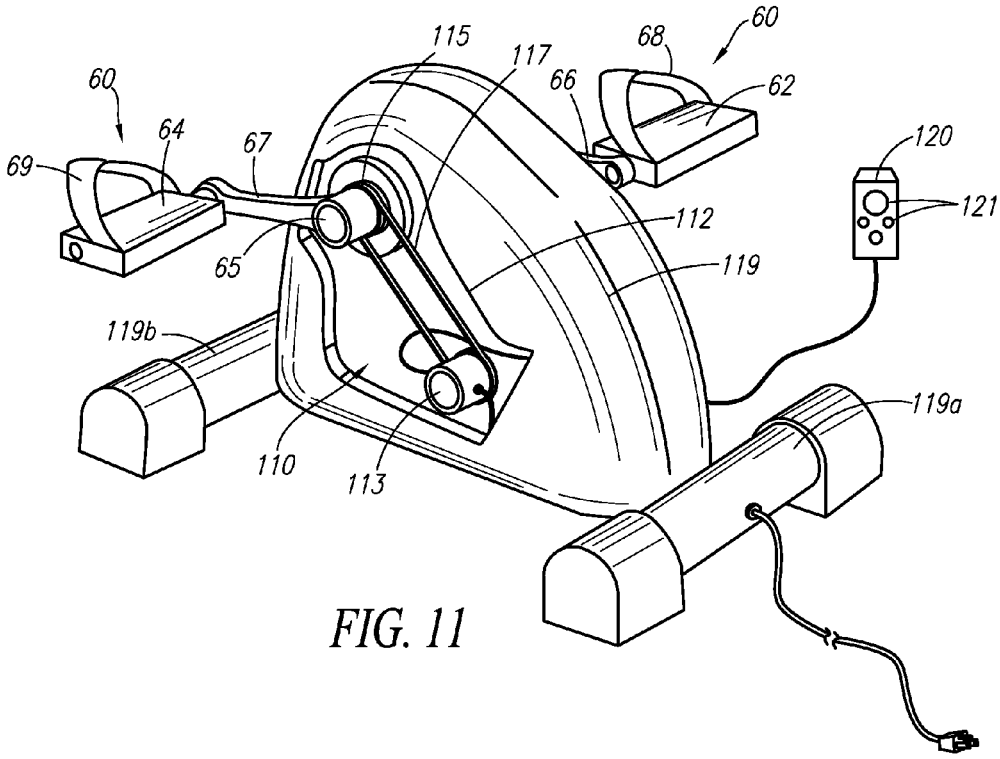
FIG. 11 is a partial cut away view of an adjustable resistance mechanism, according to one embodiment of the present invention.
Figure 12:
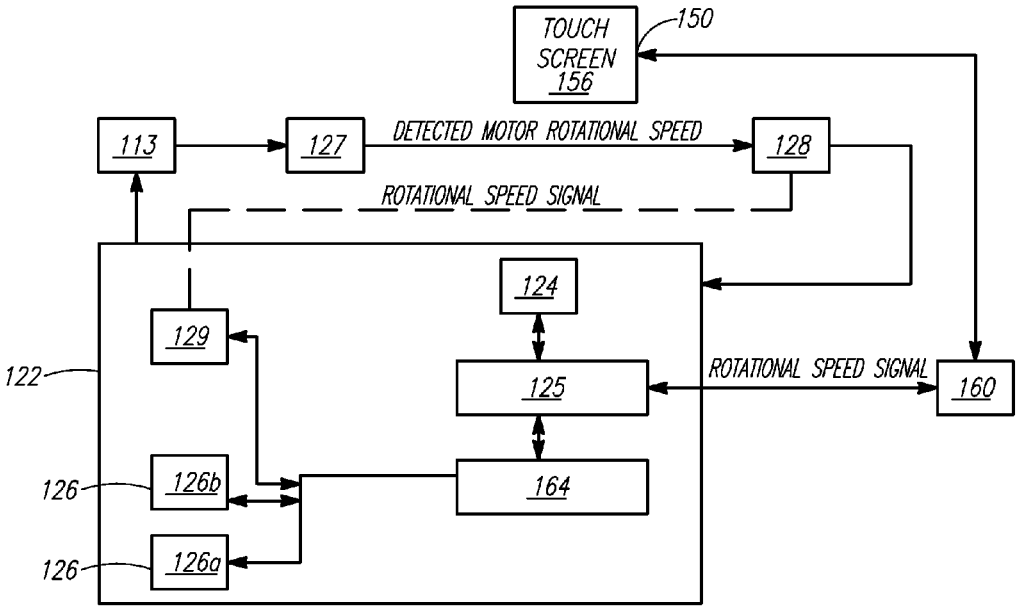
FIG. 12 is a detailed block diagram of an electronic resistance circuit, according to one embodiment of the present invention.

Referring now more specifically to FIGS. 2-3, and 11, the resistance assembly 60 comprises pedals 62, 64, such as rotatable pedals or stepping pedals, connected to the adjustable resistance mechanism 110 which applies a constant resistance or work load. The resistance mechanism 110 may be a conventional mechanism or system as is known in the art for applying a resistance or load, such as an eddy current resistance assembly presently used in other exercise machines.

In accordance to one resistance assembly 60 embodiment, the pair of rotatable pedals 62, 64 is connected to the adjustable resistance mechanism 110, the pair of pedals 62, 64 being operated by corresponding feet of user. The pair of pedals 62, 64 each includes a stirrup 68, 69, respectively, for holding a foot when foot is placed on an upper side of the pedal 62, 64. Ends of each the stirrups 68, 69 are connected to outer ends of pedals 62, 64, respectively.

The pedals 62, 64 are mounted to a pedal axle 65 via respective crank arms 66, 67. The pedals 62, 64 are rotatable about a common pivot axis 70 defined as the pedal axle 65.

To provide resistance to the rotatable movement of the pedals 62, 64, a variable or an adjustable resistance mechanism 110 is provided. While only one embodiment of the adjustable resistance mechanism 110 is being described in detail, it will become apparent that a number of known resistance means and devices could be readily employed with the present invention. One such resistance means would be an eddy current resistance assembly presently used in other exercise machines.

In accordance to one preferred embodiment, the adjustable resistance mechanism 110 comprises a drive system 112 which includes a DC motor 113, a drive reel 115, and a belt 117 or cable. The DC motor 113 is powered via a power source, such as a supply of electrical power or current. The power source may include a standard electrical wall outlet (not shown), rechargeable battery or batteries, or some other suitable means for providing the electrical input required to power and operate the DC motor 113.

The drive reel 115 is mounted to pedal axle 65. The drive reel 115 and DC motor 113 are connected via the belt 117. The belt 117 is looped around drive reel 115 and connected to DC motor 113, such as via a pinion gear. The adjustable resistance mechanism 110 is enclosed by a housing 119, the housing 119 comprising a front member 119*a* mounted perpendicular to a forward end thereof, and a rear member 119*b* mounted perpendicular to a rearward end thereof.

An electronic control unit 120 is electrically connected to DC motor 113 for controlling the DC motor 113 to rotate drive reel 115. The electronic control unit 120 includes a plurality of control buttons 121 by which user may input a selectively-desired resistance or work load. After inputting a selectively-desired resistance or work load, the selected resistance is then imposed by the electronic control unit 120 to control DC motor 113 to rotate the drive reel 115, thereby controlling displacement of the belt 117 or the degree of resistance imposed thereon, and thereby applying a desired resistive force to the pedals 62, 64.

The DC motor 113 can be driven selectively in either a forward or a reverse rotative direction. With the foregoing capabilities, the DC drive motor 113, the belt 117, and drive reel 115, when appropriately controlled, establishes the tension force supplied by the drive system 112 to the pedals 62, 64.

In accordance to an alternate embodiment, the adjustable resistance mechanism 110 may comprise an electronic resistance unit. The electronic resistance unit is electrically operated to apply a magnetic force to the belt 117. The magnetic force applied by the electronic resistance unit to the pulley belt 117 is directly controlled by a supply of electrical power or current to the electronic resistance unit. The power source may include a standard electrical wall outlet (not shown), rechargeable battery or batteries, or some other suitable means for providing the electrical input required to power and operate the electronic resistance unit. An electrical current control unit, equipped with appropriate instrumentation including a microchip or computer processing unit (CPU), controls the supply of electrical current to the electronic resistance unit. The electrical current control unit may be suitably disposed within the housing 119. The electrical current control unit may further comprise memory and a storage device (s) such as a hard disk and a portable storage device(s), wherein the CPU, memory and the storage device(s) coupled to communicate with one another. The electrical current control unit is programmed to provide a constant level of work required to move the belt 117 regardless of the rotational speed the belt 117 is moving. This programming is well known to one of ordinary skill in the art. The constant level of work required to move the belt 117 in accordance to user's desired level of resistance is then imposed by the electrical current control unit by appropriately increasing or decreasing the resistance imposed on belt 117.

The carriage assembly 19 functions to allow the adjustable resistance mechanism 110 to be vertically adjustable generally about an incline plane, thereby allowing for various selectively-desired vertical setting positions of the pedals 62, 65.

A carriage control unit 100, electrically connected to a driving means 106, controls bi-directional rotation of guide rod 32, and thus controls inclined translation of carriage assembly 19 about incline plane, and hence adjustable resistance mechanism 110, along tracks 20, 22. Carriage control unit 100 includes a plurality of translation control buttons 102 by which user may actuate translation of pedals 62, 64 to a selectively-desired inclined height. Driving means 106 may comprise a motor, such as a DC motor, a brushed DC motor, or a servomotor. The driving means 106 is powered via a power source, such as a supply of electrical power or current. The power source may include a standard electrical wall outlet (not shown), rechargeable battery or batteries, or some other suitable means for providing the electrical input required to power and operate driving means 106. The driving means 106 is securably mounted to a longitudinal member 107, the longitudinal member 107 mounted between first and second vertical member 11*a* and 11*b* of carriage assembly support frame 11. Upon activation of carriage assembly 19 via carriage control unit 100, guide rollers 27 of carriage 19 traverse tracks 20, 22, and collar 29 translates along guide rod 32 in a concurrent manner.

In reference to FIGS. 1, 4, 5, and 6, the geometry and orientation of the seat 42, pedals 62 and 64, and the pivot axes 46, 47 are oriented relative to one another so that, regardless of the size of the person using the exercise machine 10, once properly adjusted, the resulting movement and form during body conditioning is biomechanically optimized and efficient. In addition, when seat 42 is positioned in the recumbent position, the user may simultaneously perform a crunching exercise and rotatably move the pedals 62 and 64, thereby placing user in the most biomechanically, optimized position for achieving cardiovascular fitness and burning calories.

Referring now to FIGS. 1, 10, and 12-14, an input means 150, such as a display panel 152, shown herein as a touch sensitive screen 156 (to be described later in greater detail) is provided so as to allow users to input a desired level of resistance or work load. The input means 150 is adapted and configured so as to allow a user to input a selectively-desired resistance or work load by inputting data via the input means 150, thus, input means 150 provides a tactile interface through which a user may input a desired level of resistance or work load. Hence, input means 150 further provides an auxiliary or alternative means for controlling resistance or work load (electronic control unit 120 providing previously described means for controlling resistance or work load). Input means 150 comprises a resistance control module 122 equipped with appropriate instrumentation including a microchip or computer processing unit (CPU) 124 connected to DC motor 113, the module 122 programmed to allow resistance data input. Control module 122 may be suitably disposed within a housing 151 supporting display panel 152. Control module 122 further comprises memory 125 and a storage device(s) 126 such as a hard disk 126*a* and a portable storage device(s) 126*b*, wherein the CPU 124, memory 125 and the storage device(s) 126 coupled to communicate with one another. The control module 122 is programmed to allow user to input a desired level of resistance or work load imparted by pedals 62, 64 via the adjustable resistance mechanism 110. This programming is well known to one of ordinary skill in the art.

Data is input by engaging (gently pressing/deforming) and/or slidably engaging the touch sensitive screen 156 of input means 150. The input means 150 is coupled to the memory 125 and in communication therewith, and wherein the memory 125 and the CPU 124 are responsive to the input means 150.

The motor's 113 rotational speed is detected by a sensor 127 in connection with resistance control module 122. The sensor 127 communicates detected motor rotational speed to a transceiver 128 being in connection therewith, the transceiver 128 transmits a motor rotational speed signal which is received by a transceiver 129 in connection with control unit 122, the CPU 124 directs resistance control module 122 to apply an appropriate force to the motor 113, such as a magnetic force, so as to increase or decrease rotation of motor 113. The appropriate magnetic force is defined as the resistance or work load measure being consistent with the resistance or work load measure input by user via the input means 150 prior to beginning an exercise interval.

Resistance or frictional torque measure 154 can be provided in numerical units, indicating a measure of watts, to be displayed on the touch sensitive screen 156, thereby providing user with real time visual monitoring of the resistance measure as user uses the exercise machine 10 during an exercise interval.

In order to facilitate the display of resistance measure 154 by touch sensitive screen 156, transceiver 129 of resistance control module 122 transmits the received motor rotational speed signal to an indicator drive 160 in connection with transceiver 129 (via a local bus 164 and memory 125), the indicator drive 160 enables the motor rotational speed signal to be displayed on the touch sensitive screen 156 as a resistance or frictional torque measure 154, e.g. 50 watts. While, the touch sensitive screen 156 is the preferred type of display panel, other display panels may be utilized for the limited purpose of displaying data, such as a liquid crystal display (LCD) display panel (not shown) and a light-emitting diode (LED) display panel (not shown).

The touch sensitive screen 156 can be adapted for providing other information to user. Such information may include, but is not limited to rpm level, work output, calories consumed, heart rate, wattage, distance, pace data, duration of workout interval, and the like.

It is envisioned input means 150 may be further adapted and configured so as to allow a user to input a selectively-desired inclined height of pedals 62, 64. In accordance to this particular embodiment, a translation control module is programmed to allow user to input a desired height level of carriage assembly 19, and thus pedals 62, 64. Translation control module outputs a signal to CPU 124 which directs carriage assembly 19 to translate about an incline plane in accordance to the selectively-desired pedals 62, 64 inclined height level or measure input by user via the input means 150.

The use of the carriage control unit 100 or resistance control module 122, each being functionally settable to control the amount of work done by user via the pedals 62 and 64, concurrently with lying in a recumbent position in seat 42 and performing crunching exercises enables a precise programming designed to maximize the possibility of a user reaching the highest, optimized levels of cardiovascular fitness and calorie burning during a physical exercise interval.

Figure 15:
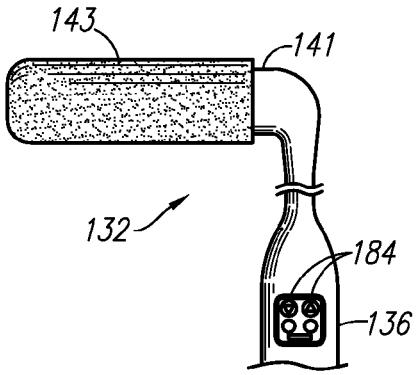
FIG. 15 is a partial top plan view of one of the pair of adjustable handles illustrating control buttons for actuating pivotal movement by the pair of adjustable handles, in accordance to one embodiment of the present invention.
Figure 16:
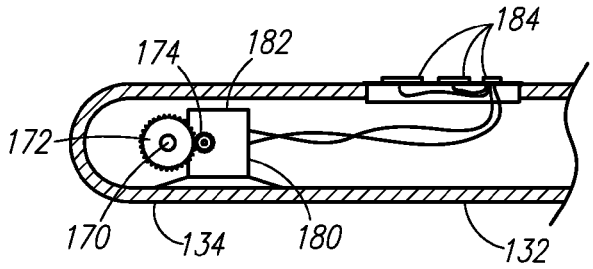
FIG. 16 is a partial cross-sectional view of one of the pair of adjustable handles showing means disposed therein for pivotally moving the handles between raised and lowered positions, in accordance to one embodiment of the present invention.

Referring now to FIGS. 1, and 15-16, secured laterally outboard of the seat 42 is a pair of adjustable handles 130 and 132. The handles 130, 132 may be suitably mounted to the frame 12, generally about central support members 15*a*, 15*b* of central support 15, or between central support members 15*a*, 15*b* of central support 15 and rear support 16 members 16*a*, 16*b* of rear support 16. Alternatively, handles 130, 132 may be suitably mounted to seat 42.

The handles 130, 132 each define an elongated configuration having a rearward end 133, 134, a body portion 135, 136, and a forward end 137, 138 terminating into an inwardly curved grip 140, 141 oriented perpendicular with respect to body portion 135, 136. The grips 140 and 141 may be covered with a cushioned sleeve 142, 143.

Means are provided for allowing the handles 130 and 132 to pivotally move electromechanically between raised and lowered positions. In accordance to one embodiment, means for allowing pivotal movement by handles 130 and 132 may include an axle 170 extending from the rearward end 133 of first handle 130, through seat 42 and into the rearward end 134 of second handle 132. One end of axle 170 is mounted with a hub 172 driven by a pinion gear 174 connected to a reversible actuator 180, the reversible actuator 180 being electrically connected to a plurality of control buttons 184 for actuating simultaneous pivotal movement by the handles 130 and 132 between raised and lowered positions. The actuator 180 is suitably mounted inside a chamber 182 provided in one of the rearward ends 133 and 134 of the handles 130 and 132, respectively. The control buttons 184 may be disposed along the body portion 135 of the first handle 130 or the body portion 136 of the second handle 132, the control buttons 184 are oriented in a position providing user with quick, easy, and efficient access thereto.

Figure 10:
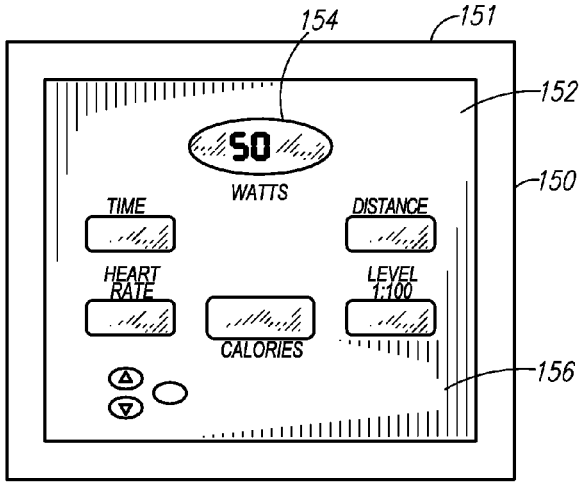
FIG. 10 is a front view of an input means, shown herein as a display panel having a touch sensitive screen, in accordance to one embodiment of the present invention.
Figure 13:
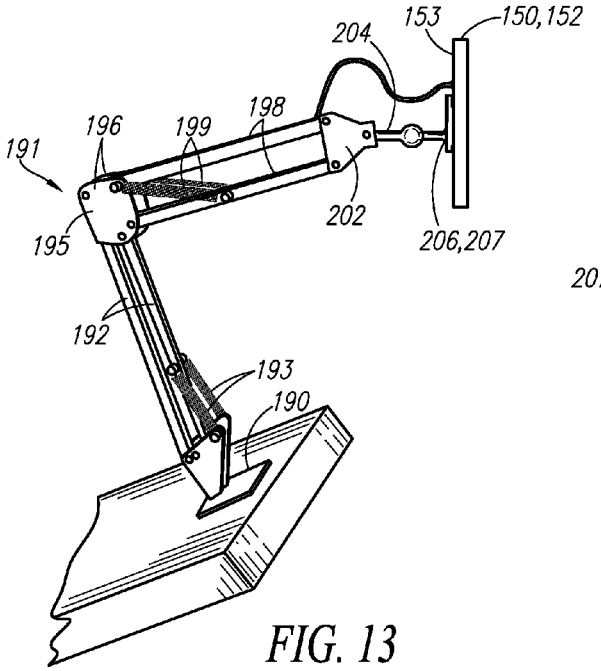
FIG. 13 is a side elevational view of a display panel coupled to exercise machine via a panel adjustment assembly with means for providing display panel with omnidirectional positionability, in accordance to one embodiment of the present invention.
Figure 14:
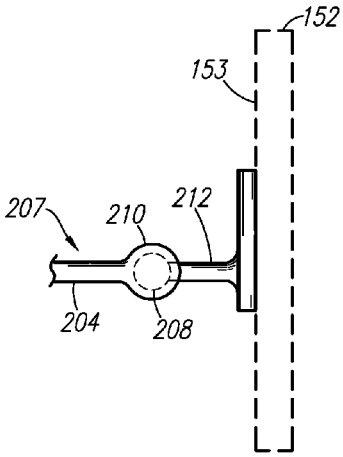
FIG. 14 is a side elevational view of a joint assembly, in accordance to one embodiment of the present invention.

Referring now to FIGS. 1 and 10, and more particularly to FIGS. 13 and 14, the input means 150 comprises a display panel 152 comprising a touch sensitive screen 156, wherein display panel 152 is mounted via a base support 190 to the panel adjustment assembly support 200 which is securably mounted, such as by arc welding, transversely to the upper surface of track 20 and sidewall of cross member 28. Base support 190 includes means for providing omnidirectional positionability of the display panel 152, the omnidirectional positionability of display panel 152 affords important, unanticipated, nonobvious functional utility to the present invention.

The base support 190 includes a panel adjustment assembly 191 comprising a first pair of legs 192 hingedly coupled to base support 190, the first pair of legs 192 biased by a first pair of biasing members 193, respectively, pivotally secured about a forward wall of each respective leg 192. The biasing members 193 bias the first pair of legs 192 in a generally vertical position. Upper ends of the first pair of legs 192 are pivotally coupled to a pivot header 195 comprising a pair of plates 196 between which a second pair of legs 198 are pivotally coupled about lower ends thereof. The second pair of legs 198 is biased in a generally vertical position by way of a pair of spring members 199 extending between the legs 198 and respective plates 196. The spring members 199 have one end respectively secured to the pair of plates 196 and an opposing end respectively secured about a mid-length of the pair of legs 198.

Upper ends of the second pair of legs 198 is pivotally coupled to a pivot bracket 202, the pivot bracket 202 may comprise a generally triangular configuration. An arm 204 pivotally secures display panel 152 to pivot bracket 202. The arm 204 having a lower end pivotally mounted to a pivot bracket 202, and an upper end having a joint assembly 206 adjustably connecting a rear side 153 of display panel 152 thereto. Joint assembly 206 comprises a ball and socket joint assembly 207 comprising a ball portion 208, a socket portion 210, and a shaft 212. The socket portion 210 is molded integral to upper end of arm 204, wherein the ball portion 208 seats in and is rotatable within the socket portion 210. The shaft 212 has a first end extending integrally from the ball portion 202 and a second end mounted to the rear side 153 of display panel 152, such as via a mounting plate.

The panel adjustment assembly 191 allows the input means 150, shown herein as display panel 152, to be positioned omnidirectionally and maneuvered in accordance to user's needs, preferences, and desires. The omnidirectional positionability of the display panel 152 via the panel adjustment assembly 191 further allows the touch sensitive screen 156 to be easily accessed particularly after user has adjusted seat 42 and/or back rest 44 in accordance to user's body dimension, comfort, fit, and exercise program needs.

Figure 5:
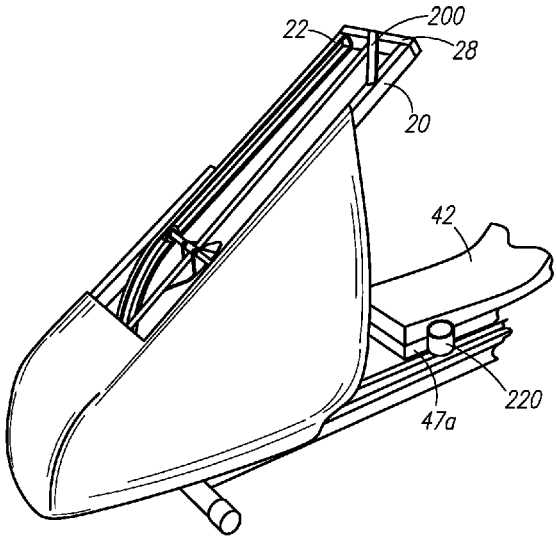
FIG. 5 is a left frontal perspective view of the exercise machine, shown with the shroud partially removed, in accordance to one embodiment of the present invention.
Figure 6:
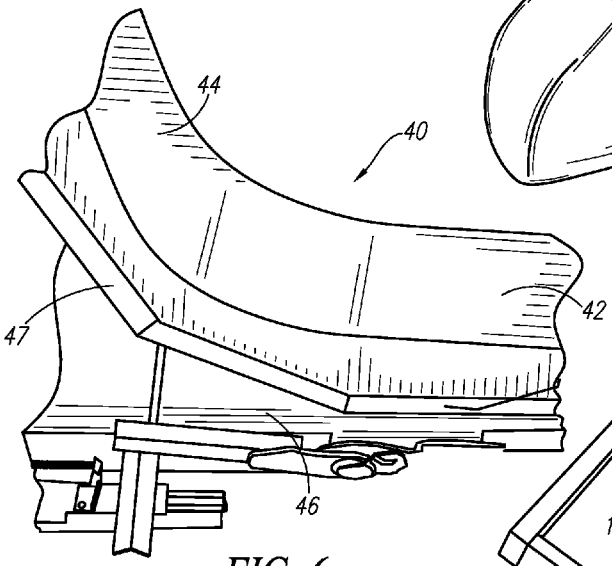
FIG. 6 is a right side elevational view of a seat assembly, illustrating the pivot axes thereof, in accordance to one embodiment of the present invention.
Figure 7:
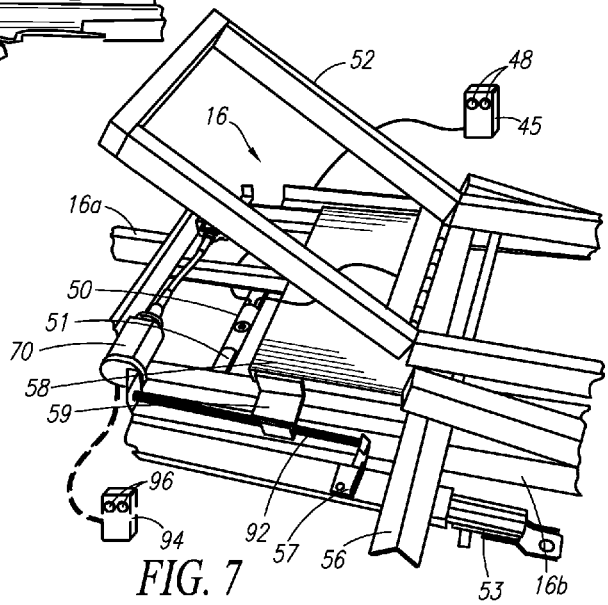
FIG. 7 is a partial right perspective view of the seat assembly, shown with cushion portion removed, illustrating one means for sliding the seat assembly axially along the frame of the exercise machine, in accordance to one embodiment of the present invention.
Figure 8:
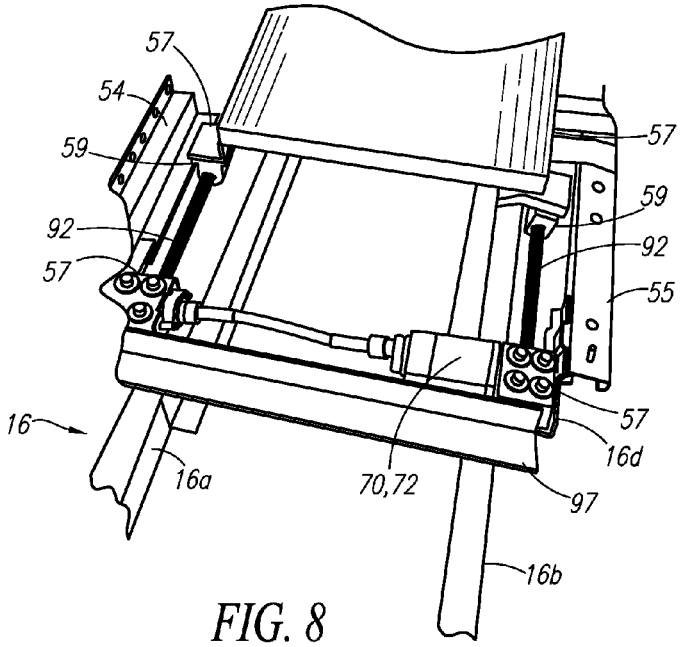
FIG. 8 is a partial rear perspective view of the seat assembly of FIG. 7.
Figure 8A:
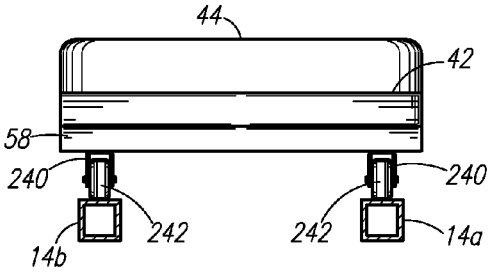
FIG. 8A is a partial front end elevational view of the seat platform shown rotatably engaged with the front support members of frame, according to one embodiment of the present invention.
Figure 9:
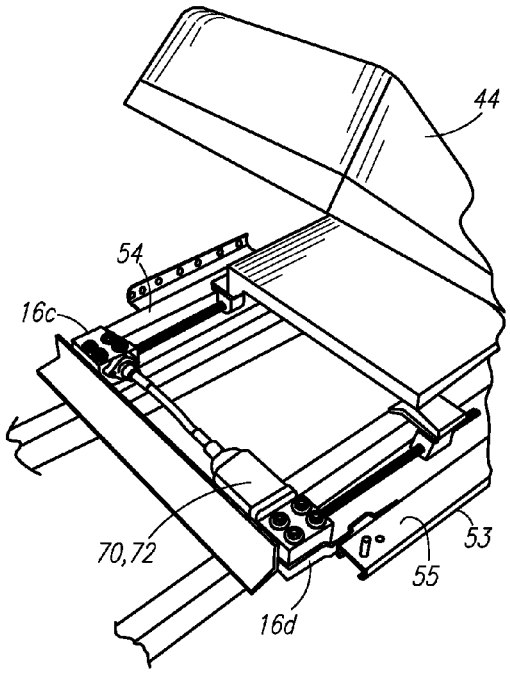
FIG. 9 is a partial right rear perspective view the seat assembly illustrating one means for sliding the seat assembly axially along the frame of the exercise machine, in accordance to one embodiment of the present invention.

Finally, in reference to FIG. 5, at least one beverage holder 220 may be provided for supporting a beverage container, such as a cup or bottle. The beverage holder 220 may be suitably attached to the base of the seat 42.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An exercise machine comprising:

a frame, the frame includes a front support, a central support, and a rear support, the front support and the rear support are integrally joined by the central support, and wherein the front support is spaced from the rear support generally along a central axis;

a seat assembly;

means for slidably adjusting the seat assembly axially along the frame, the means for slidably adjusting the seat assembly comprises:

an electric drive assembly, the electric drive assembly being actuated for sliding the seat assembly axially along the frame, thereby allowing for varied axially-positioned adjustment of the seat assembly; and a seat control unit, the seat control unit is electrically connected to the electric drive assembly, the seat control unit controls axial translation of the seat assembly by signaling the electric drive assembly to actuate forward and reverse translation of the seat assembly in accordance to a user's longitudinal seat position preference;

means for pivotally adjusting the seat assembly between a generally upright position and a recumbent position, the means for pivotally adjusting the seat assembly comprises a pivot control mechanism;

a resistance assembly, the resistance assembly comprises: first and second pedals; and an adjustable resistance mechanism, wherein the first and second pedals are connected to the adjustable resistance mechanism for operation therewith, the first and second pedals are rotatably operated by corresponding feet of the user, the adjustable resistance mechanism provides resistance to the rotatable movement of the first and second pedals, and wherein the adjustable resistance mechanism comprises an electronic control unit electrically connected thereto, the electronic control unit includes a plurality of control buttons by which the user inputs a selectively-desired resistance or work load, the electronic control unit selectively controls a measure of resistance or work load imposed by the adjustable resistance mechanism;

an input means, the input means comprising means for providing omnidirectional positionability of the input means;

a carriage assembly support frame, the carriage assembly support frame comprises a first vertical member and a second vertical member, the first vertical member and the second vertical member each includes an upper end and a lower end, the lower end of the first vertical member and the lower end of the second vertical member are mounted to the front support of the frame, the upper end of the first vertical member and the upper end of the second vertical member are welded or molded integral to a cross member, the first vertical member has an outer wall to which a first stanchion is mounted or welded, and the second vertical member has an outer wall to which a second stanchion is mounted or welded; and a carriage assembly, the carriage assembly is supported by the carriage assembly support frame, the carriage assembly functions to allow the adjustable resistance mechanism to be vertically adjustable generally about an incline plane, thereby allowing for various selectively-desired vertical setting positions of the first and second pedals, the carriage assembly comprises:

a transverse support rod having ends rotatably mounted with guide rollers;

a pair of tracks, the pair of tracks are respectively mounted to inner side walls of the first stanchion and the second stanchion, the pair of tracks each comprises a pair of flanges joined by a central web, the flanges provide bearing surfaces on which the guide rollers rotatably engage, the pair of tracks each further defines curved lower ends, the pair of tracks having upper ends mounted to a cross member; and a pair of support brackets for securably supporting the adjustable resistance mechanism, the pair of support brackets is mounted spatially about the transverse support rod and include a lower surface edge to which a front member of a housing of the adjustable resistance mechanism is suitably mounted, the pair of support brackets includes inner walls joined by an annular collar suitably mounted therebetween for threaded translation along a guide rod, the guide rod is rotatably mounted perpendicularly between the cross member, mounted to upper ends of the pair of tracks, and a receiver being mounted to the front support, wherein the guide rod includes male threads being threadedly engaged by the annular collar, the guide rod is electrically connected to a driving device, whereupon actuation of a driving device causes the guide rod to rotate either clockwise or counterclockwise, and upon rotation by the guide rod in one direction causes the annular collar to translate about the guide rod in a sloped or inclinational direction, thereby causing the adjustable resistance mechanism to translate in one inclinational direction, and rotation by the guide rod in the opposite direction causes the adjustable resistance mechanism to translate in the opposite inclinational direction.

2. The exercise machine of claim 1, further comprising a panel adjustment assembly support securably mounted transversely to an upper surface of one of the pair of tracks and a sidewall of the cross member to which the upper ends of the pair of tracks is mounted, and wherein the input means is mounted via a base support to the panel adjustment assembly support, the base support includes means for providing omnidirectional positionability of the input means.

3. The exercise machine of claim 2, wherein the input means includes a tactile interface through which the user inputs a desired level of resistance or work load.

4. The exercise machine of claim 3, wherein the input means comprises a touch sensitive screen, the input means providing an auxiliary means for controlling resistance or work load imposed by the adjustable resistance mechanism, and wherein the touch sensitive screen via the tactile interface allows the user to input a selectively-desired inclined height of the first and second pedals.

5. The exercise machine of claim 1, further comprising a shroud portion extending between the front support and the central support of the frame, the shroud portion partially encloses the carriage assembly and the adjustable resistance mechanism.

6. The exercise machine of claim 5, wherein the shroud portion comprises a generally conical shape having an elongated sloped forward segment.

7. The exercise machine of claim 1, wherein the seat assembly comprises a seat portion, a back rest, and a pivot control unit, wherein the back rest being pivotally adjustable automatically about a first pivot axis and a second pivot axis via actuation of the pivot control unit, the pivot control unit is electrically connected to a pivot drive mechanism, the pivot drive mechanism is suitably secured to a cross beam mounted perpendicularly between the rear support, the pivot control unit controls the pivot drive mechanism to pivotally raise and lower the back rest about the first pivot axis and the second pivot axis, the pivot control unit controls the pivot drive mechanism to pivotally raise and lower the seat portion of the seat assembly about a third pivot axis, and wherein the pivot control unit includes a plurality of pivot control buttons by which the user depresses or inputs a selectively-desired back rest pivotal position.

8. The exercise machine of claim 7, wherein the seat portion and the back rest are positionable to a recumbent position, thus allowing the user to simultaneously perform a crunching exercise and rotatably engage the resistance assembly via the first and second pedals, thereby placing user in a most biomechanically, optimized position for achieving highest, optimized levels of cardiovascular fitness and calorie burning during a physical exercise interval.

9. The exercise machine of claim 1, further comprising a pair of adjustable handles, the pair of adjustable handles respectively secured laterally outboard of the seat assembly.

10. The exercise machine of claim 9, further comprising means for pivotally moving the pair of adjustable handles electromechanically between raised and lowered positions.

11. The exercise machine of claim 1, wherein the carriage assembly further comprises a carriage control unit for controlling inclined translation of the adjustable resistance mechanism about the incline plane, the carriage control unit is electrically connected to the driving device, the carriage control unit controls bi-directional rotation of the guide rod, and thus the carriage control unit controls inclined translation of the carriage assembly about the incline plane, and hence the carriage control unit controls inclined translation of the adjustable resistance mechanism along the pair of tracks, and wherein the carriage control unit includes a plurality of translation control buttons by which the user actuates translation of the first and second pedals to a selectively-desired inclined height.

12. An exercise machine comprising:

a frame, the frame includes a front support, a central support, and a rear support, the front support and the rear support are integrally joined by the central support, and wherein the front support is spaced from the rear support generally along a central axis;

a seat assembly;

means for slidably adjusting the seat assembly axially along the frame;

means for pivotally adjusting the seat assembly between a generally upright position and a recumbent position;

a resistance assembly;

an input means, the input means comprising means for providing omnidirectional positionability of the input means, the means for providing omnidirectional positionability of the input means comprises:

a panel adjustment assembly comprising:

a base support;

a first pair of legs;

a second pair of legs;

a pivot header;

a pivot bracket; and a joint assembly, wherein the first pair of legs is hingedly coupled between the base support and the pivot header, the pivot header comprising a pair of plates between which the second pair of legs is pivotally coupled, the second pair of legs is pivotally coupled about upper ends thereof to the pivot bracket, the joint assembly adjustably connecting a rear side of the input means to the pivot bracket, wherein the input means is pivotally secured to the pivot bracket via an arm, the joint assembly comprises a ball and socket joint assembly comprising a ball portion, a socket portion, and a shaft, the socket portion is molded integral to an upper end of the arm, wherein the ball portion seats in and is rotatable within the socket portion, the shaft has a first end extending integrally from the ball portion and a second end mounted to the rear side of the input means;

a carriage assembly support frame; and a carriage assembly, the carriage assembly is supported by the carriage assembly support frame, the carriage assembly functions to allow an adjustable resistance mechanism of the resistance assembly to be vertically adjustable generally about an incline plane, the carriage assembly comprises:

a track assembly; and a carriage control unit for controlling inclined translation of the adjustable resistance mechanism along the track assembly.

13. The exercise machine of claim 12, further comprising a beverage holder suitably attached thereto.

* * * * *